US006158522A

United States Patent [19]

Laderoute

[11] Patent Number: 6,158,522

[45] **Date of Patent: *Dec. 12, 2000**

[54] FIRE-EXTINGUISHER NOZZLE

[75] Inventor: Michael J Laderoute, Charlottesville, Va.

[73] Assignee: Kiddie-Fenwal, Inc., Ashland, Mass.

[ * ] Notice: This patent issued on a continued prosecution application filed under 37 CFR 1.53(d), and is subject to the twenty year patent term provisions of 35 U.S.C. 154(a)(2).

[21] Appl. No.: 09/030,577

[22] Filed: Feb. 24, 1998

[51] Int. Cl.[7] ..... A62C 31/02; A62C 13/62

[52] U.S. Cl. ..... 169/46; 169/74; 239/71; 239/309

[58] Field of Search ..... 169/71, 74, 89, 169/46; 239/71, 309, 463, 487

[56] References Cited

U.S. PATENT DOCUMENTS

| | | | |
|---|---|---|---|
| 1,719,277 | 7/1929 | Packer | 169/74 |
| 2,430,470 | 11/1947 | Keefe | 169/74 X |
| 2,564,733 | 8/1951 | Sipkin | 169/89 |
| 2,635,376 | 4/1953 | Allen et al. | 169/30 X |
| 4,570,858 | 2/1986 | Bentner et al. | 239/71 X |
| 5,456,411 | 10/1995 | Scott et al. | 239/74 X |
| 5,845,716 | 12/1998 | Birk | 169/71 X |

FOREIGN PATENT DOCUMENTS

| | | | |
|---|---|---|---|
| 117023 | 8/1984 | European Pat. Off. | 239/71 |
| 3-272780 | 12/1991 | Japan | 169/89 |
| 403625 | 12/1933 | United Kingdom | 239/71 |

*Primary Examiner*—Kevin Weldon
*Attorney, Agent, or Firm*—Fish & Richardson P.C.

[57] ABSTRACT

A nozzle includes a housing defining a fluid passage. A member is positioned to block the fluid passage when the nozzle is not spraying fluid. A retainer attached to the housing retains the member in the disposed position. The surface of the housing has one or more marks. The number of marks indicates the spray profile produced by the nozzle. The member is disposed within the fluid passage and bursts under the flow of fluid.

15 Claims, 1 Drawing Sheet

FIRE-EXTINGUISHER NOZZLE

BACKGROUND OF THE INVENTION

The invention relates to nozzles used to dispense fluid from fire-extinguisher systems. Fire-extinguisher systems are commonly installed in commercial settings such as in commercial kitchens or restaurants. These systems dispense extinguishing fluid according to design specifications. Nozzles are attached to the system that will spray fluid in a pattern, known as a spray profile, that is consistent with the specification. When not in use, the nozzles are exposed to debris, such as dirt and grease, that can obstruct the flow passage of the nozzle.

It is known to place a plastic cap over the tip of the nozzle to prevent debris from entering the nozzle. When the system is activated, pressure builds from within the nozzle and pushes the cap off the tip of the nozzle allowing fluid to be dispensed.

SUMMARY OF THE INVENTION

According to the invention a nozzle includes a housing defining a fluid passage. A member, e.g., a foil, is positioned to block the fluid passage when the nozzle is not spraying fluid. A retainer attached to the housing retains the member in the disposed position.

Preferred embodiments of this aspect of the invention may include one or more of the following features.

The foil bursts under the flow of fluid. The retainer is threaded onto the housing. The housing is formed as a single piece.

In another aspect of the invention, a surface of the housing of the nozzle contains one or more identifying marks, e.g., circumferential grooves. The number of marks indicates a spray profile of the nozzle.

According to another aspect of the invention, a nozzle includes a housing defining a fluid passage, and a member disposed in the fluid passage for blocking the fluid passage when the nozzle is not spraying fluid. The member is constructed to burst under the flow of fluid.

According to another aspect of the invention, a method of preventing debris form entering a nozzle includes placing a member within a fluid passage of the nozzle to block the fluid passage when the nozzle is not spraying fluid. The member is burst by flowing fluid into the nozzle to allow delivery of fluid through the nozzle.

Among other advantages, the member prevents debris, especially kitchen grease, from clogging the fluid passage of the nozzle when the nozzle is not spraying fluid. The member is capable of quickly bursting when the nozzle is activated and fluid begins to flow. However, the member is retained against the nozzle and will not separate from the tip of the nozzle over time. The marks on the nozzle allow an operator to easily identify the type of spray profile that will be produced by the nozzle.

DESCRIPTION OF THE PREFERRED EMBODIMENTS

Figure 1:
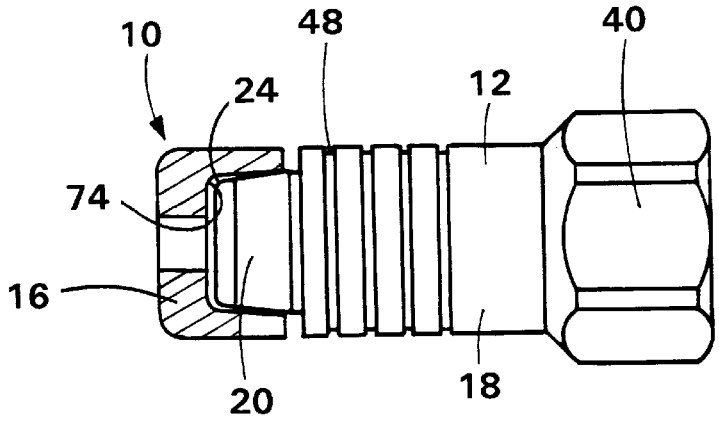
FIG. 1 is a partial cross-sectional view of a fire-extinguisher nozzle.
Figure 2:
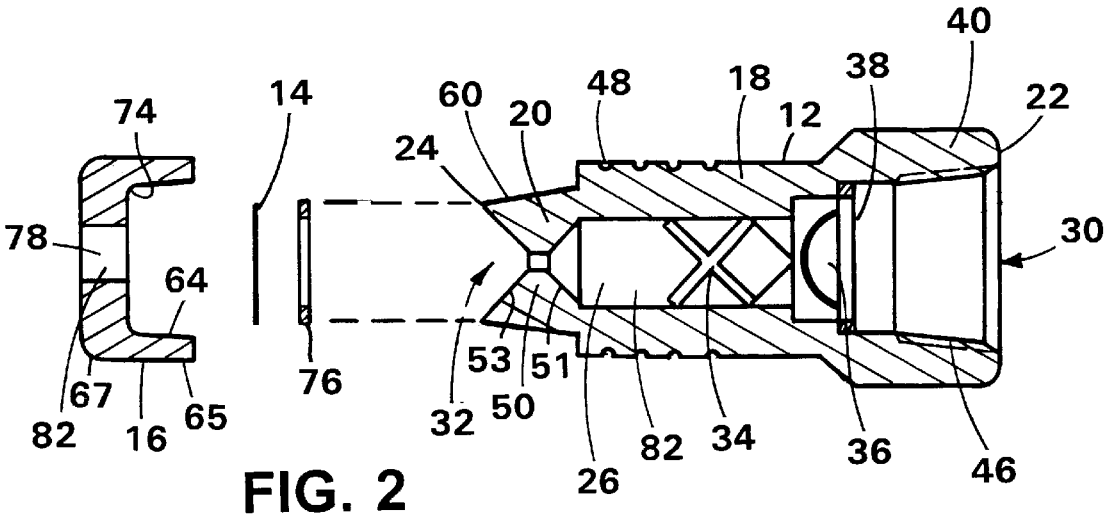
FIG. 2 is an exploded cross-sectional view of the fire-extinguisher nozzle shown in FIG. 1.

Referring to FIGS. 1 and 2, a fire-extinguisher nozzle 10 suitable for dispensing fluid, especially water, from a fire extinguishing system includes a housing 12, a foil 14, and a foil retainer 16. Foil 14 prevents debris from entering the nozzle and bursts under the flow of extinguisher fluid. Housing 12 is a generally cylindrical structure constructed from a single piece of material and has openings 30, 32 at a proximal end 22 and a distal end 24, respectively. Housing 12 has two distinct regions: a nozzle body 18 that lies toward the proximal end 22 of housing 12, and a nozzle tip 20 that lies toward the distal end 24 of housing 12. Housing 12 has an internal passageway 26 extending through nozzle body 18 and nozzle tip 20, and terminating at proximal end opening 30 and distal end opening 32.

Nozzle body 18 houses a vane 34 and a cup strainer 36 positioned within internal passageway 26. Vane 34 spans across internal passageway 26 and affects the flow of fluid through internal passageway 26. Cup strainer 36 is a porous mesh that lies closer to proximal end 22 than vane 34 and completely covers internal passageway 26. Cup strainer 36 is held in place by, e.g., a retaining ring 38. Nozzle body 18 has a hexagonal head 40 at proximal end 22 that can accommodate a wrench or other tool for attaching nozzle 10 to an extinguisher system. Hexagonal head 40 has an internal thread 46.

A set of rings 48 are engraved into the outer surface of nozzle body 18 to a depth of, e.g., 0.795 mm (0.031"). The number of rings informs the operator of the particular spray profile (described below) produced by nozzle 10.

Nozzle tip 20 has a constricted region 50 where the diameter of internal passageway 26 is reduced. Moving in a direction from proximal end 22 to distal end 24, the diameter of passageway 26 first decreases in a proximal section 51 of constricted region 50 and then increases in a distal section 53 of constricted region 50.

Nozzle tip 20 includes an external thread 60. Retainer 16 has a first section 65 including an internal thread 64 for attaching retainer 16 to nozzle tip 20. A second section of retainer 16 has a passage 78. A lip 74 is defined by section 67. Lip 74 abuts distal end 24 of housing 12 when retainer 16 is attached to nozzle tip 20 as shown in FIG. 1. When retainer 16 is attached to nozzle tip 20, passage 78 and internal passageway 26 combine to form a fluid passage 82.

Foil 14 lies against lip 74 and within fluid passage 82. A mounting disk 76, e.g. a washer, positioned between foil 14 and distal end 24 of housing 12 supports the foil. When retainer 16 is attached to nozzle tip 20, foil 14 completely covers opening 32 at distal end 24. This configuration prevents debris such as kitchen grease, which collects on nozzle 10 when the extinguisher system is idle, from clogging internal passageway 26.

As an example, nozzle 10 is constructed in the following configuration. Housing 12 has a length of 45.67 mm (1.781") and is constructed of brass with nickel-chrome plating. Vane 34 is constructed of brass. Cup strainer 36 is constructed of a stainless steel mesh. Retaining ring 38 is also constructed of stainless steel. Retainer 16 is constructed of brass with a nickel-chrome plating. Foil 14 is composed of a thin, pliable metal such as tin, and mounting disk 76 is brass.

In operation, with nozzle 10 attached to a fire-extinguishing system, e.g., a system installed in a commercial kitchen, when a fire is sensed, a extinguishing fluid flows though fluid passage 82 and is dispensed from distal end 24 of housing 12. Foil 14 is a thin, pliable material which bursts quickly under the pressure formed when the extinguisher system is activated and fluid begins to flow through internal passageway 26. However, because foil 14 is retained against housing 12 by retainer 16, foil 14 will not separate from housing 12 prior to or during activation of the extinguishing system.

As fluid flows through internal passageway 26, cup strainer 36, which lies upstream of vane 34, filters out debris in the fluid, e.g., rust or minerals, that may lodge against vane 34 or constricted region 50. Vane 34 disrupts the continuous fluid flow to create a flow of fluid droplets. The fluid droplets pass through constricted region 50 which causes the droplets to be dispensed in a spray profile. It is known to configure vane 34 to provide a particular droplet size that, when coupled with the configuration of constricted region 50, determines the spray profile.

Figure 3:
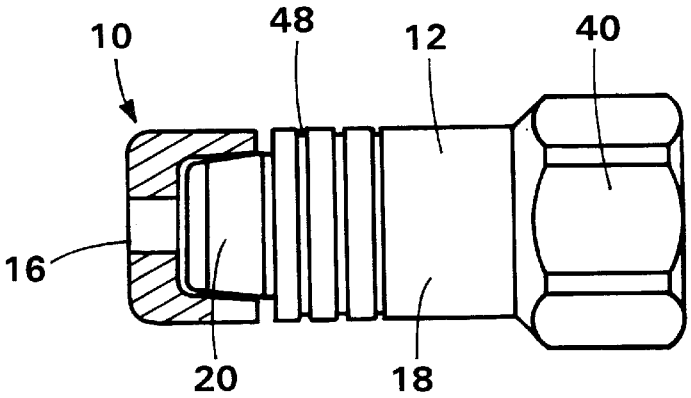
FIG. 3 is a partial cross-sectional view of an additional embodiment of a fire-extinguisher nozzle.

Rings 48 are engraved in patterns which correspond to the particular spray profile of the nozzle. Rings 48 allow a nozzle 10 having a particular spray profile to be easily identified, e.g., for installation or replacement in an extinguishing system according to the design specifications. For example, as shown in FIG. 1, four rings 48 correspond to a "full cone" spray profile of 90.0° (+/−10°) at 100 pounds/square inch (psi) in nozzle 10 having a narrow diameter 56 of 1.667 mm (0.065") and a flow capacity of 1.00 gallon/minute (gpm) (+/−5%); as shown in FIG. 3, three rings 48 correspond to a "full cone" spray profile of 46.0° (+/−10°) at 100 psi in nozzle 10 having a narrow diameter 56 of 1.590 mm (0.062") and a flow capacity of 0.92 gpm (+/−5%); two rings 48 correspond to a "full cone" spray profile of 30.0° (+/−10°) at 100 psi in nozzle 10 having a narrow diameter 56 of 2.487 mm (0.097") and a flow capacity of 2.20 gpm (+/−5%); one ring 48 corresponds to a "full cone" spray profile of 46.0° (+/−10°) at 100 psi in nozzle 10 having a narrow diameter 56 of 1.667 mm (0.065") and a flow capacity of 1.00 gpm (+/−5%); no rings 48 correspond to a "full cone" spray profile of 61.0° (+/−10°) at 100 psi in nozzle 10 having a narrow diameter 56 of 2.897 mm (0.113") and a flow capacity of 3.00 gpm (+/−5%).

Other embodiments are within the scope of the following claims.

For example, other conventions may be chosen to correlate a particular ring pattern to a particular spray profile. Other visual marks, such as a number of painted lines, may be used to signify a particular spray pattern. In addition, the marks may signify more than the spray profile, e.g., capacity or size. The foil and retainer may also take on additional configurations. For example, the foil may be a plastic membrane, or the retainer may be an adhesive substance.

What is claimed is:

1. A nozzle comprising, a housing defining a fluid passage including a fluid outlet for delivery of fire-extinguishing fluid to a fire, the housing being configured for releasable attachment to a fire-extinguishing system, a vane for controlling the spray profile of fluid exiting from the nozzle, a member disposed in a position for blocking the fluid passage when the nozzle is not delivering fire-extinguishing fluid, and a retainer attached to the housing for retaining the member in the disposed position.

2. The nozzle of claim 1 wherein the member comprises a foil.

3. The nozzle of claim 2 wherein the foil is constructed to burst under the flow of fluid.

4. The nozzle of claim 1 wherein the retainer is threadedly attached to the housing.

5. The nozzle of claim 4 wherein the member is positioned in the fluid passage.

6. The nozzle of claim 1 wherein the housing is formed as a single piece.

7. The nozzle of claim 1 wherein a surface of the housing has one or more identifying marks, the number of marks indicating a spray profile of the nozzle.

8. The nozzle of claim 7 wherein the mark is a circumferential groove.

9. The nozzle of claim 1 further comprising a constricted region in the fluid passage for controlling the spray profile of fluid exiting from the nozzle.

10. A nozzle comprising:

a housing defining a fluid passage including a fluid outlet for delivery of fire-extinguishing fluid to a fire, the housing being configured for releasable attachment to a fire-extinguishing system, a vane for controlling the spray profile of fluid exiting from the nozzle, and a member disposed in the fluid passage for blocking the fluid passage when the nozzle is not delivering fire-extinguishing fluid, the member being constructed to burst under flow of fire-extinguishing fluid.

11. The nozzle of claim 10, wherein a surface of the housing has one or more identifying marks, the number of marks indicating a spray profile of the nozzle.

12. The nozzle of claim 11 wherein the mark is a circumferential groove.

13. The nozzle of claim 10 further comprising a constricted region in the fluid passage for controlling the spray profile of fluid exiting from the nozzle.

14. A method of preventing debris from entering a nozzle releasably attachable to a source of fire extinguishing fluid, comprising placing a member within a fluid passage of the nozzle, the fluid passage including a fluid outlet for delivery of fire-extinguishing fluid to a fire, the nozzle including a vane for controlling the spray profile of fluid exiting from the nozzle, the member blocking the fluid passage when the nozzle is not spraying fire-extinguishing fluid, and bursting the member by flowing fire-extinguishing fluid into the nozzle to allow delivery of fire-extinguishing fluid through the nozzle to extinguish a fire.

15. The method of claim 14 further comprising providing the fluid passage with a constricted region for controlling the spray profile of fluid exiting from the nozzle.

* * * * *

UNITED STATES PATENT AND TRADEMARK OFFICE

CERTIFICATE OF CORRECTION

PATENT NO. : 6,158,522
DATED : December 12, 2000
INVENTOR(S) : Michael J. Laderoute It is certified that error appears in the above-identified patent and that said Letters Patent is hereby corrected as shown below:

Title page,
After "Assignee:" delete [Kiddie-Fenwal, Inc.] and substitute therefor -- Kidde-Fenwal, Inc. --

Signed and Sealed this

Eighteenth Day of December, 2001

*Attest:*

*Attesting Officer*

JAMES E. ROGAN
*Director of the United States Patent and Trademark Office*